United States Patent [19]

Blair

[11] Patent Number: 5,010,700

[45] Date of Patent: Apr. 30, 1991

[54] ROOF JACK

[76] Inventor: Earl Blair, 19340 E. San Jose Ave., City of Industry, Calif. 91748

[21] Appl. No.: 581,422

[22] Filed: Jul. 23, 1990

Related U.S. Application Data

[63] Continuation of Ser. No. 374,286, Jun. 30, 1989, abandoned.

[51] Int. Cl.[5] ..... E04H 12/28

[52] U.S. Cl. ..... 52/199; 52/48; 52/219; 285/42; 285/44

[58] Field of Search ..... 52/199, 219, 58; 285/42, 43, 44

[56] References Cited

U.S. PATENT DOCUMENTS

| | | | |
|---|---|---|---|
| 1,317,574 | 9/1919 | Grosvold | 285/44 |
| 3,731,952 | 5/1973 | Elwart | 285/44 X |
| 4,333,660 | 6/1982 | Cupit | 285/42 X |
| 4,526,407 | 7/1985 | Kifer | 285/42 |
| 4,563,847 | 1/1986 | Hasty | 52/199 X |
| 4,570,943 | 2/1986 | Houseman et al. | 285/43 X |

FOREIGN PATENT DOCUMENTS

| | | | |
|---|---|---|---|
| 2360538 | 6/1975 | Fed. Rep. of Germany | 285/44 |

*Primary Examiner*—David A. Scherbel
*Assistant Examiner*—Linda J. Watson
*Attorney, Agent, or Firm*—Wagner & Middlebrook

[57] ABSTRACT

A roof jack or vent seal which is unitarily vacuum formed of polypropylene synthetic rubber polymer and a U.V. stabilized pigment and which has a planar roof covering with a central upstanding frusto-conical section including stepped graduated portions, with the region between each graduated portion capable of flexing to accommodate differences in the roof pitch.

15 Claims, 6 Drawing Sheets

ROOF JACK

This is a continuation of copending applications Ser. No. 07/374,286 filed on Jun. 30, 1989, now abandoned.

BACKGROUND OF THE INVENTION

From the earliest days of man's shelter, there has existed a need to penetrate a roof with either a chimney or other pipe or outlet while maintaining integrity of the roof against the elements of rain and snow. The advent of vented plumbing systems requires that a residence or business building have a significant number of vents which penetrate the roof. As a result, countless structures have been evolved through the years to seal openings in roofs. The devices which are used to seal are commonly called "vent seals", "roof jacks" or "pitch boxes". They all require some means for securing the vent seal or roof jack to the roof surface and some means to seal the vent seal or roof jack to a pipe or conduit exiting the roof. A further requirement is that the vent seal or roof jack can accommodate to the size of the vent, the roof surface material and roof pitch. In achieving all of these requirements, the structures have become unduly complex, increasing in cost and difficult to install.

Examples of prior art devices facing this problem are illustrated in the following patents:

| | | |
|---|---|---|
| U.S. Pat. No. 4,768,812 | B. Katz | Sept. 6, 1988 |
| U.S. Pat. No. 4,730,421 | D. F. Leeland | March 15, 1988 |
| U.S. Pat. No. 4,563,847 | W. E. Hasty | Jan. 14, 1986 |
| U.S. Pat. No. 4,280,305 | D. D. Logsdon | July 28, 1981 |
| U.S. Pat. No. 4,265,058 | D. D. Logsdon | May 5, 1981 |
| U.S. Pat. No. 4,115,961 | R. L. Bishop | Sept. 26, 1978 |
| U.S. Pat. No. 4,010,578 | D. D. Logsdon | March 8, 1977 |
| U.S. Pat. No. 3,945,163 | Nagler, et al | March 23, 1976 |
| U.S. Pat. No. 3,797,181 | F. J. Nievelt | March 19, 1974. |

None of the above references meet the objective of a single design of a single unitary structure capable of effectively sealing a roof vent of variety of sizes to a roof of a variety of pitches. Likewise, none of the prior art vent seals are particularly easy to install with the assurance of a tight seal.

Likewise, prior art roof jacks or vent seals have not been designed to effectively seal on non-planar roofs such as corrugated tile roofs.

BRIEF DESCRIPTION OF INVENTION

Faced with the above state of the art, I have determined that certain thermal plastic sheet materials have sufficient dimensional and environmental stability and the capability of being vacuum formed into a vent seal. I likewise, determined that a single design can be evolved which accommodates a variety of vent pipes and effectively seals to each of the variety of vent pipe sizes. We have also determined that it is possible to have a single unitary member which is capable of receiving vent pipes on a roof having a broad range of pitches, well distributed through the full range of pitches encountered in normal construction. I have also determined that it is possible to develop a unitary roof jack which is easily installed requiring only a minimum amount of sealing material and having a durability equal to the durability of the roof with which it will be installed.

I have achieved all of the above in a vacuum formed structure made of polypropylene-synthetic rubber polymer with a U.V. stabilized pigment in a form which includes a planar roof covering surface with a central upstanding frusto-conical section. Extending above the frusto-conical section is a stepped graduated portion with the internal diameter of each of the steps corresponding to the outside diameter of popular roof vent sizes graded. Between the frusto-conical section and the stepped sealing section is a transition region which is capable of flexing to accommodate the differences in the pitch of the roof. The transition section is preferably in the form of accordion pleats. The entire structure is produced by a single vacuum formed operation.

In another embodiment of this invention designed particularly for flat roofs on which standing water presents a sealing problem, the embodiment includes a planar portion to be sealed to the roof and an upstanding portion which may terminate in graduated stepped tubes to accommodate a very slight pitch. In the embodiment dedicated to planar roofs with the danger of standing water, the upstanding portion is sealed to the vent and includes a run-off trough from the vent region. An overlying cap fits loosely over the upstanding portion and is permanently or loosely sealed to the vent pipe. Any water reaching the trough portion runs out without entering the roof. In this latter embodiment, the basic roof jack is the single element and the cap is the second element with graduated openings to match varying vent sizes. The central portion of the top of the column is adjustable by slits to accommodate different sizes and is sealed by a liquid sealant around the pipe in defining the run-off region to an outlet spot.

In still another embodiment, the planar base of the roof jack is corrugated in the longitudinal or down slope direction to provide a favored direction of bending to allow the planar portion to bend to conform to the corrugated or other shape of non-planar roofs such as Spanish tile. An integral stiffening agent which may be bent by hand on installation is included in the transverse edge of the planar portion of the roof jack.

BRIEF DESCRIPTION OF DRAWING

This invention may be more clearly understood from the following detailed description and by reference to the drawing which.

DETAILED DESCRIPTION OF INVENTION

Figure 1:
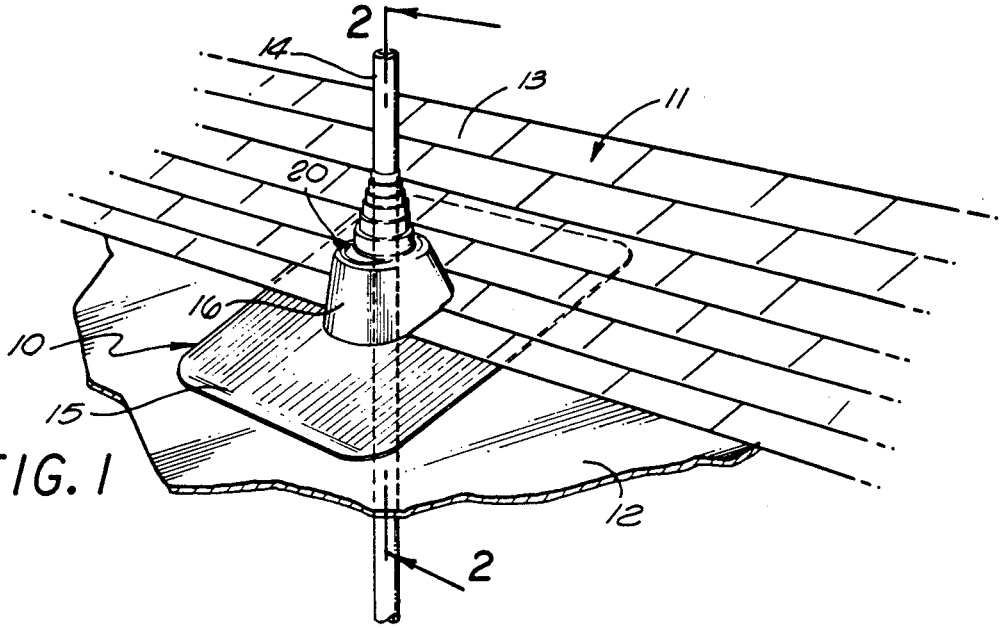
FIG. 1 is a perspective view of a roof with a roof jack or vent seal invention installed.
Figure 2:
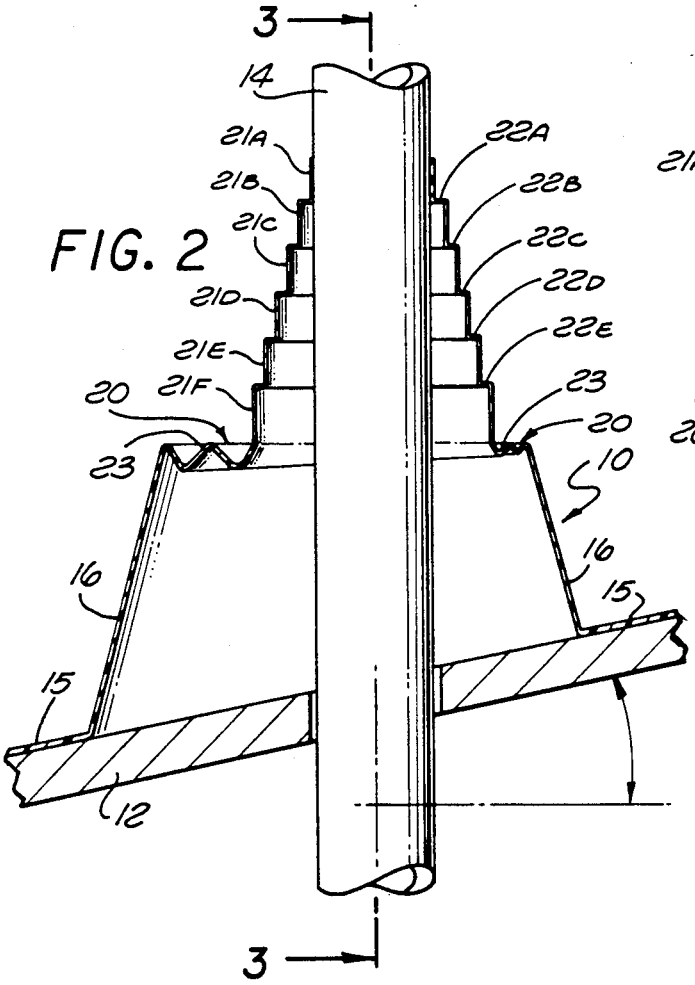
FIG. 2 is a vertical sectional view of the roof jack of FIG. 1, as installed, in FIG. 1 taken along line 2—2 of FIG. 1.
Figure 3:
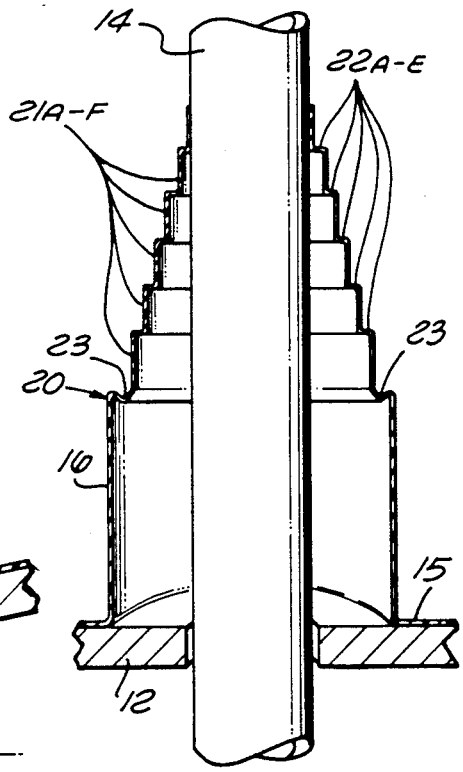
FIG. 3 is a vertical sectional view taken along line 3—3 of FIG. 1.
Figure 4:
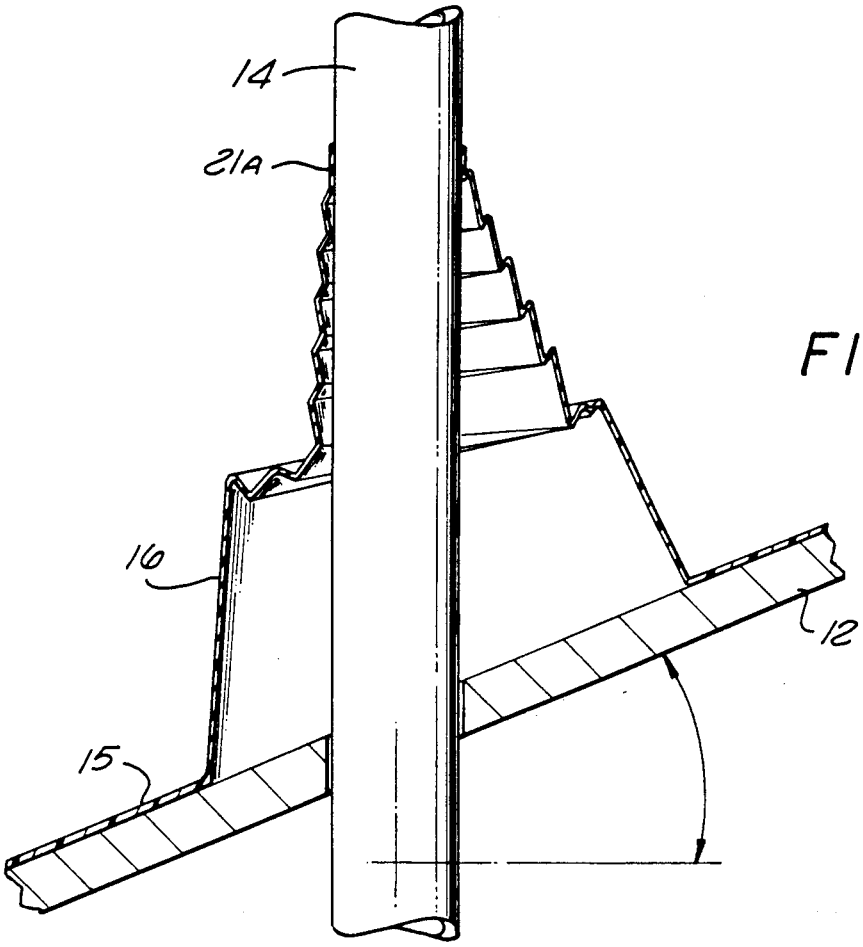
FIG. 4 is a vertical sectional view of similar to FIGS. 1-3, but taken of a roof jack installed on a roof having a greater pitch than in FIGS. 1-3.

This invention in its preferred embodiment may be seen in FIG. 1 in combination with FIGS. 2–4. In FIG. 1, a roof jack or vent seal 10 is seen in its location in place on a shingled roof 11 between the under layer or subroof 12 and the shingles 13. The roof jack 10 is used to seal a vent pipe or a conduit 14 as it passes through the roof 11.

The roof jack 10 may be seen as being a unitary member including a planar portion 15 which overlies the under roof layer 12 and is below the shingles 13. The planar portion 15 surrounds a central upstanding portion or base section 16 of an oblong frusto-conical shape with a tapered platform or transition portion 20. Above the transition 20 are a series of stacked graduated tubular portions, for example, six in number 21 A–F joined by steps 22 A–E, best seen in FIGS. 2 and 3. The transition region 20 differs from the steps 22 A–E in that it includes corrugation 23 which provide a significant degree of deformability to the raised portion of the roof jack 10 without deformation of the planar portion 15, the upstanding portion 16 or the stacked tubular portions 21 A–F. This corrugated portion 20 includes two corrugations at the elongated ends of the upstanding portion 16 and a single corrugation on the sides as may be seen by comparing FIGS. 2 and 3. This is true since the elongated direction is the preferred direction for installing the jack 10 on the roof to conform to the pitch of the roof 11. The shorter height of the upstanding portion 16 is mounted toward the peak or ridge 11A of the roof 11 on a pitched roof as is illustrated in FIGS. 1–4. In the embodiment of FIGS. 1–4 the upstanding portion is slanted in the order of 10 degrees with respect to the planar portion but may be slanted at 0 degrees to 20 degrees and provide virtually universal application to pitched planar roofs. The corrugated transition portion is easily distortable +or −10 degrees from its normal slant to provide for precise roof slope accommodation. The upstanding portion is preferably truncated at its sides to planar form to allow close positioning of shingles without the need for carving the shingles to a curved shape.

A comparison of FIGS. 2 and 4 shows that the same roof jack 10 may be used on roofs of significantly different pitch without undue distortion of the tubular section 21A which actually mates with the vent pipe 14. In FIG. 2, the roof has a pitch of 15 degrees to 20 degrees while in FIG. 4, the roof illustrated has a pitch of 20 degrees to 30 degrees. We have found that this invention may be used on roofs having a pitch as great as 12:12 or 45 degrees with effective sealing. Therefore the same roof jack may be used for virtually all normal pitched roofs. In any event, the use of some mastic or sealant around the vent pipe 14 as it exits the roof jack 10, either of the outside or inside of the roof jack 10 is recommended for further protection against leakage through the years.

Figure 5:
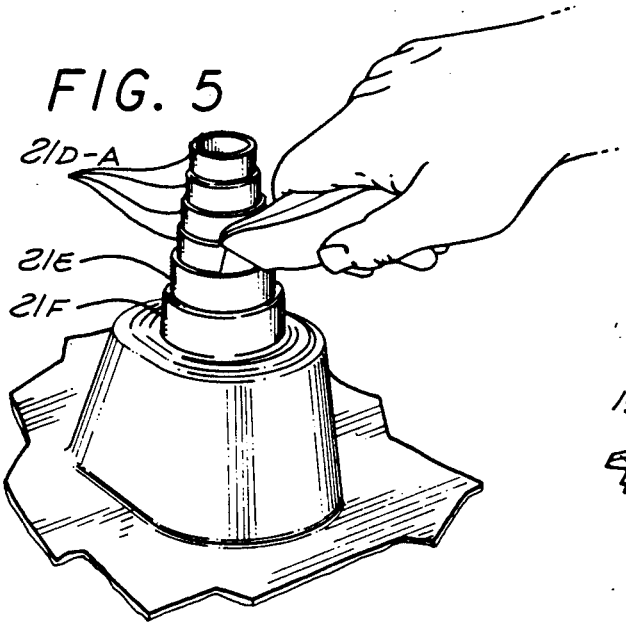
FIG. 5 is a perspective view of an installer adjusting the roof jack of this invention to a particular size vent.
Figure 6:
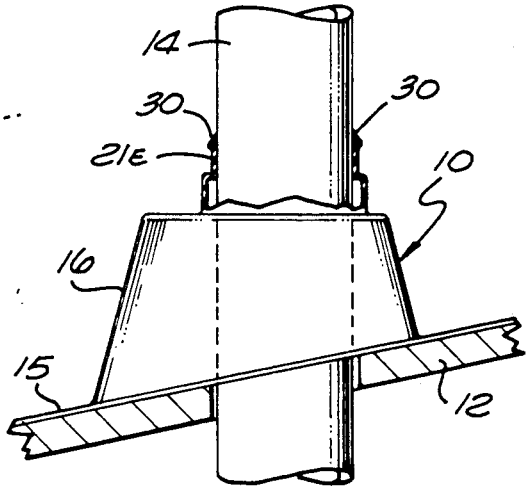
FIG. 6 is a side elevational view of the roof jack of FIG. 5 when installed with portions broken away for clarity.

The roof jack of this invention likewise is adaptable to several sizes of vent pipes constituting virtually all of the vent sizes used in residential construction and many of the sizes used on commercial and industrial installations, as well. At least two stepped portions makes the roof jack 10 adaptable to most vents, however in the preferred embodiment six stepped portions are preferred to accommodate virtually the full range of roof vent pipe sizes including both plumbing and electrical pipes. The adaption of the roof jack 10 to different sized vent pipes, on site during the installation, is simply accomplished as is illustrated in FIGS. 5 and 6. In the preferred embodiment, the steps have internal diameters of approximately, $1\frac{1}{8}''$, $1\frac{5}{8}''$, $1\frac{7}{8}''$, $2\frac{1}{8}''$, $2\frac{5}{8}''$, and $3\frac{1}{4}''$.

After the vent pipe size has been determined by eye or by measurement, the step which corresponds in diameter with the outside diameter of the vent pipe is identified and a knife is used to cut the step above the selected tubular section as illustrated in step FIG. 5. The appropriate diameter, in the case illustrated is step 21E. The step 22E, therefore is cut just inside the edge by a distance approximately the wall thickness of the roof jack 10, e.g 0.010+0.045 in. The cutoff portion of the stacked tubular sections, in this case, sections 21 D - A are discarded. A bead of mastic or other long life flexible sealant is wiped on the inner surface of the section 21E or use no mastic if not needed and the roof jack 10 is slipped over the in place vent pipe 14 and adjusted till the roof jack 10 rests firmly on the surface 12 of the roof 11. Additional sealant 30 may be added to the joint of the section 21E and the vent pipe 14.

Figure 7:
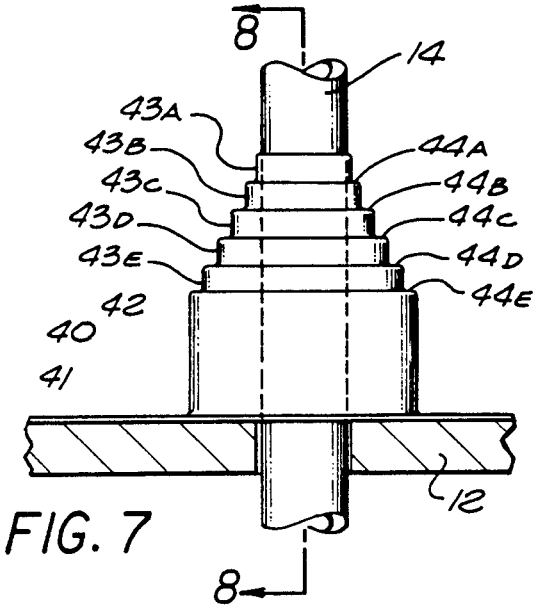
FIG. 7 is a side elevational view of an alternate embodiment of this installed on a flat roof.
Figure 8:
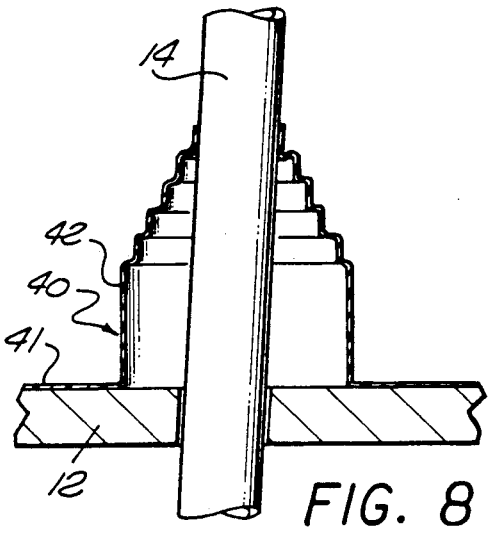
FIG. 8 is a vertical section of the roof jack of FIG. 7.

For flat roofs, the embodiments of FIGS. 7 and 8 and FIGS. 9 and 10 are preferred. In FIGS. 7 and 8 a similar unitary roof jack or vent seal 40 may be seen as including a planar portion 41, an upstanding portion 42 and a series of stepped tubular portions 43 A–E of standard outside diameters for commonly used vent pipes or conduits 14.

Each stepped tubular portion 43 A–E is spaced by an annular generally planar portion 44 A–E similar to the embodiment of FIGS. 1–4.

The selection of the diameter and the cutting the excess smaller sections is done in the same manner described above in connection with FIGS. 5 and 6.

In certain industrial and commercial installations using a flat roof, there are occasions on which water stands on the roof to a depth of one or more inches. In these installations, a more positive form of vent seal is required. Such an embodiment is illustrated on FIGS. 9–14.

Figure 9:
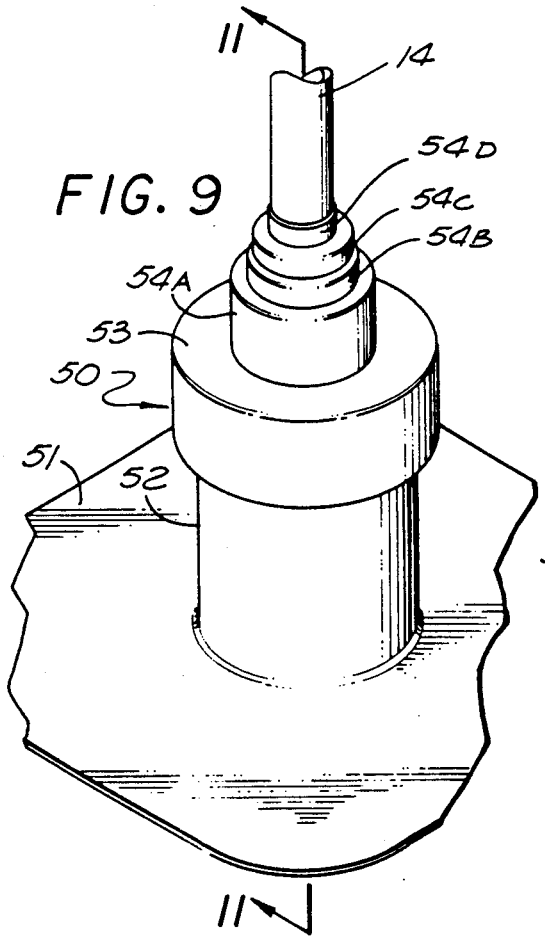
FIG. 9 is a perspective view of another embodiment of this invention including a cap.
Figure 10:
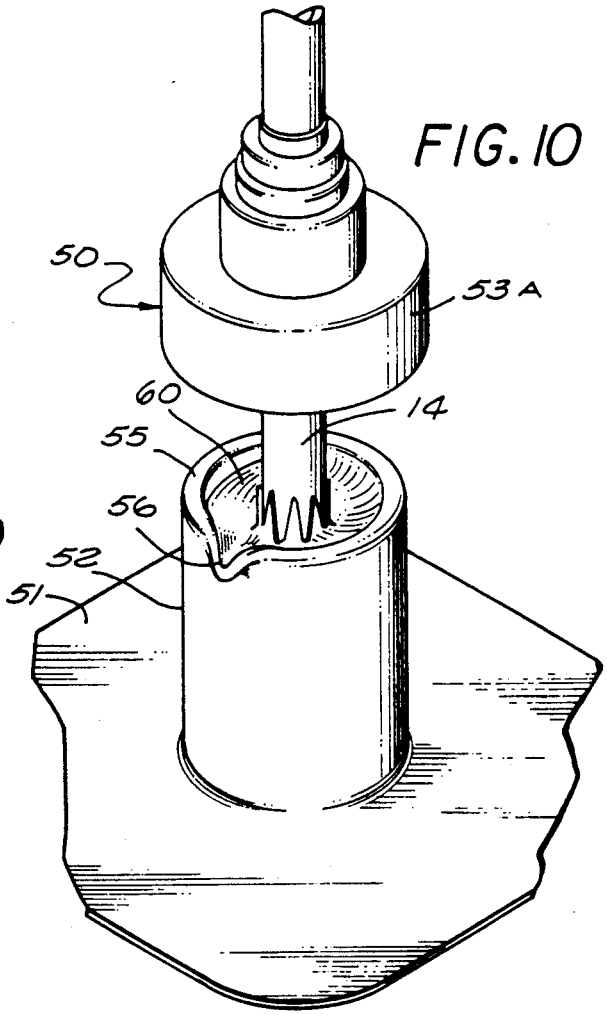
FIG. 10 is a perspective view of the embodiment of FIG. 9 with the cap lifted.
Figure 11:
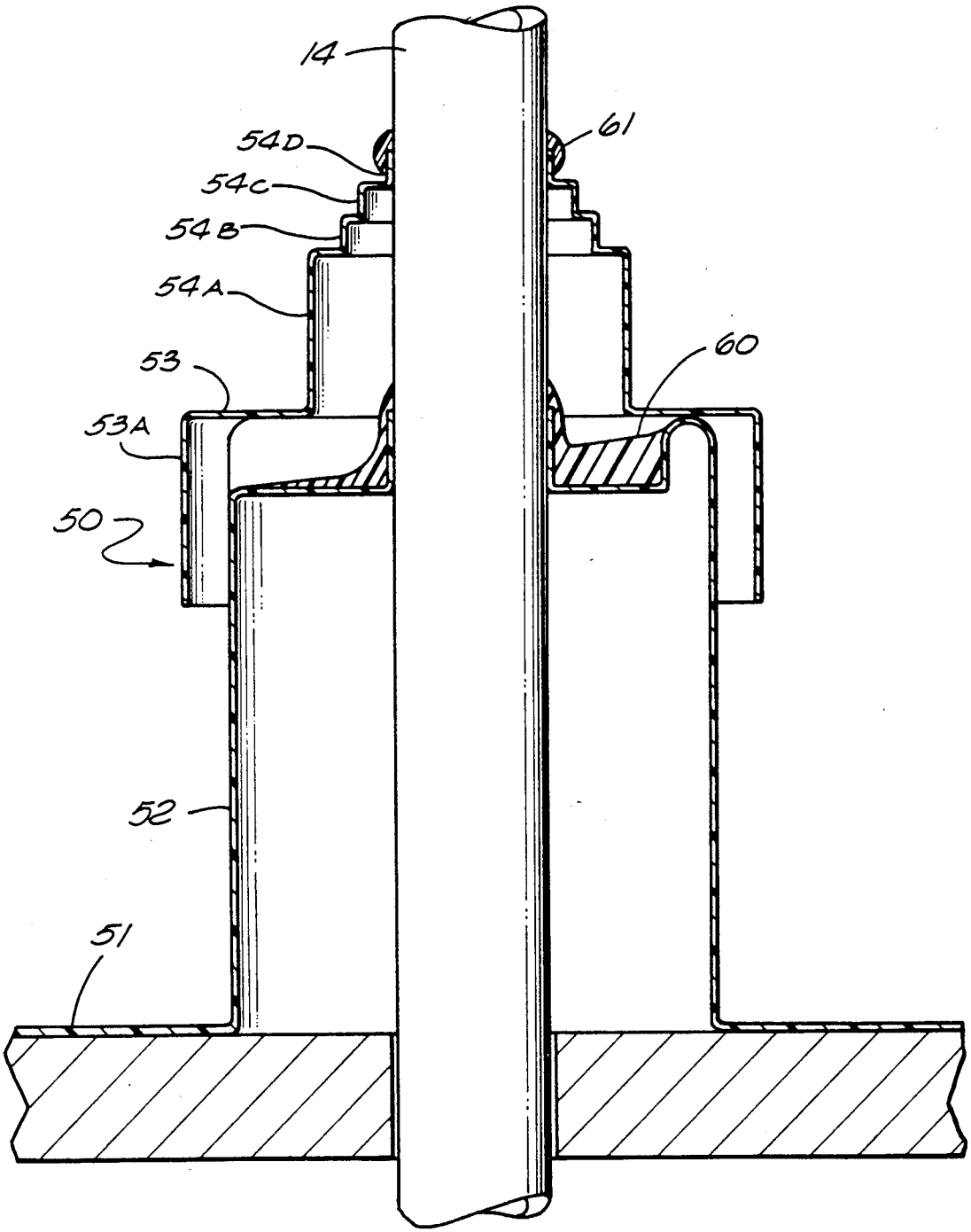
FIG. 11 is a vertical sectional view of the embodiment of FIGS. 9 and 10.

Referring now to FIGS. 9–11, a roof jack 50 is illustrated including a planar portion 51, an upstanding portion 52 and a cap 53 which closely fits over the upstanding portion 52. The cap 50 includes a number of stepped tubular portions 54 A–D similar to the portions 43 A–E, each dimensioned to closely conform to standard sized vent pipes such as pipe 14.

Referring now to FIGS. 10 and 11, in which the cap 50 has been raised on pipe 14 to show the details of the top of the upstanding portion 52. The top of the upstanding portion 52 includes a rim 55 with a spout 56 and an inclined drain surface 60. The central portion of the top has been radially split to the diameter of the vent 14 assuring a tight fit. The tapered or inclined portion 60 is formed preferably of mastic or other sealant which also seals the vent pipe 14 to the upstanding portio 52 of the roof jack 50. Typically the upstanding portion 52 is in the order of 6 inches high, sufficient to provide a seal to prevent any entrance of surface water through the roof jack 50.

When the cap 50 is lowered so that its skirt portion 50A extends below the rim 55 of the upstanding portion 52, any surface water from above runs down the skirt portion 50A and drops to the roof surface. The clearance between the skirt portion 50A and the upstanding portion 52 of the roof jack 50 insures that no moisture from the cap will enter the roof. The uppermost tubular portion 54D in the embodiment illustrated is preferably sealed by some sealant to the vent pipe 14 although we have found that by proper sizing of the tubular portions, a close fit is achieved which obviates the absolute need for a sealant around the cap. The installer may feel more comfortable with a use of the sealant for the cap and it may be used. Since the cap 50 may be sealed before it is slipped down to its final position, is easily done. When in place, an additional sealant bead 61 may be added to the assembly as illustrated in FIG. 11. If any moisture does inter the top seal of the cap 50, it harmlessly runs down the vent pipe 14 to the inclined trough 60 and out through spout 56.

Figure 12:
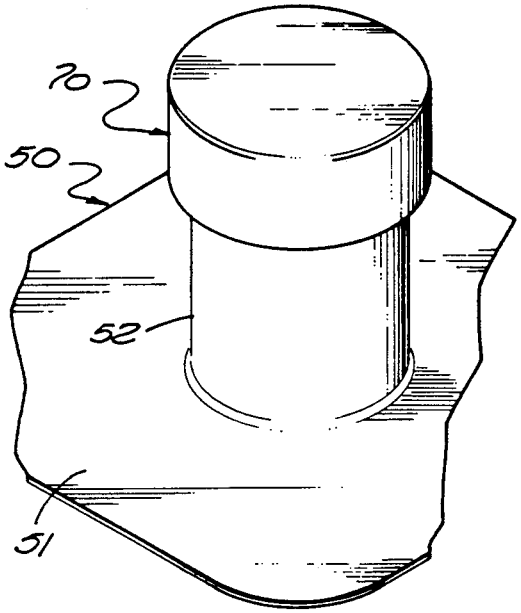
FIG. 12 is a perspective view of still another embodiment of this invention adapted to seal a variety of shapes and devices penetrating a roof with a need to be sealed.
Figure 13:
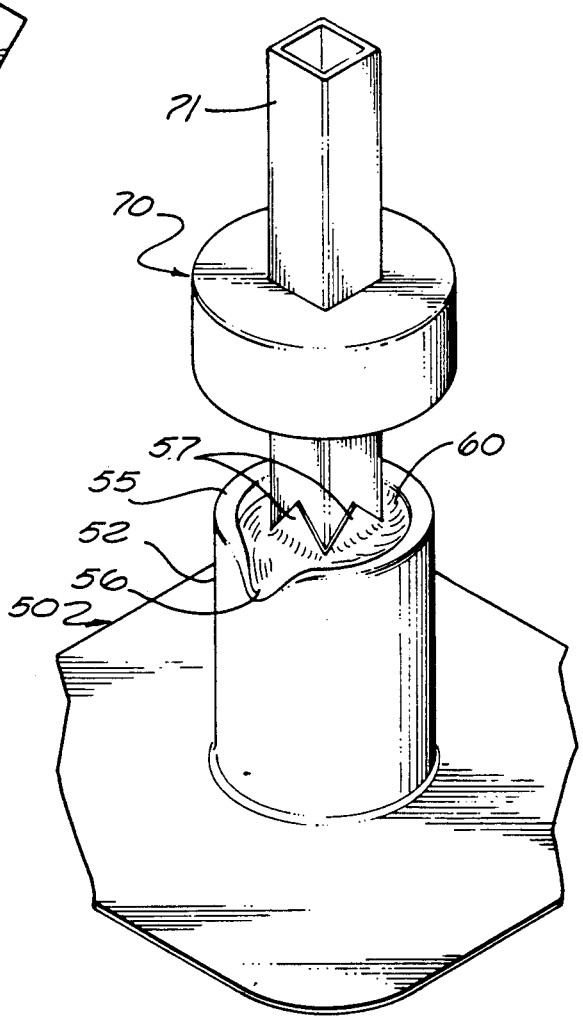
FIGS. 13 and 14 are perspective views of the embodiment of FIG. 12 with the cap elevated and with different shapes and members penetrating the roof jack and in sealed engagement therewith.
Figure 14:
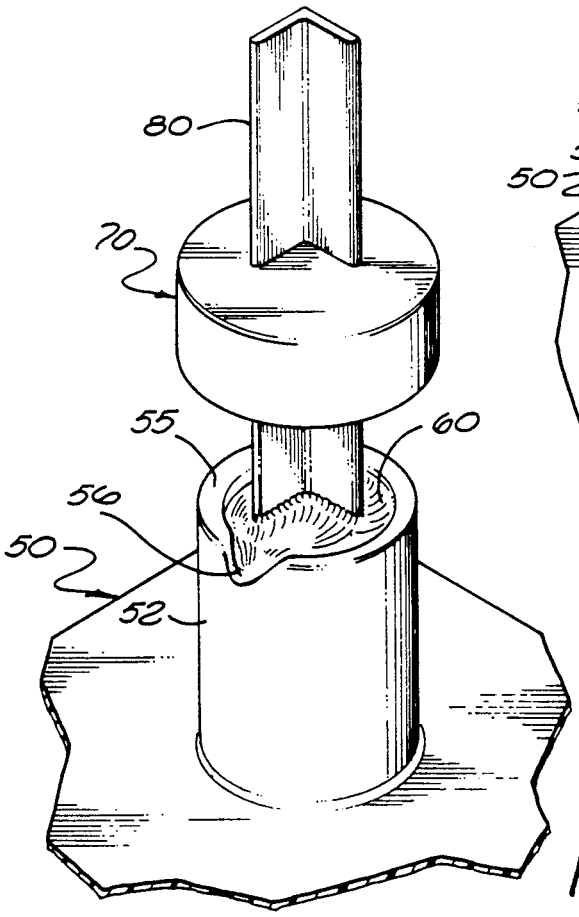
Figure 15:
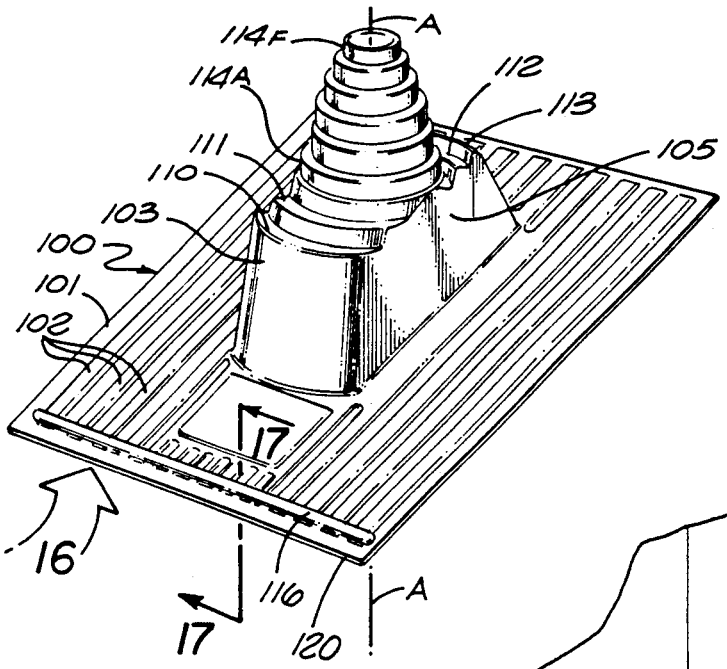
FIG. 15 is a perspective view of a corrugated embodiment including ribs and a lateral bendable stiffener.

The embodiment of FIGS. 9-10 have the further advantage for use in commercial and industrial applications in which some structure other than a round vent pipe must pass through a roof and be sealed from leakage. By employing the roof jack 50 of FIGS. 9 and 10 with a planar or slightly domed cap 70 as shown in FIGS. 12-14, any type structure may pass through the roof jack 50 with assured sealing from water entrance. The upstanding portion 52 must have a diameter or minimum transverse dimension, if not round, within its rim 55, which is greater than the maximum dimension of 15 the structure which is intended to be sealed.

In FIG. 13, a hollow square tube 71 is sealed by the roof jack 50. A pair of crossed slots have been cut by the installer, on site in the top of the upstanding portion 52 within the rim 55 to provide a close fitting square opening through the roof jack 50. The triangular portions 57 due to plastic memory rest against the side walls of the square tube 70. Sealant 60 extends up the side of the tube 70 to provide an effective seal.

The cap 70, has either crossed slots similar to the upstanding portion 52 or may have the shape of the structure passing through it cut out entirely by the installer. FIG. 13 shows the crossed slot penetration through the upstanding portion 52 and a full cut out for the cap 70. Sealant should be placed around the junction of the cap 70 and the structure 71 that the cap is in place.

FIG. 14 illustrates the roof jack 50 seals a structural angle 80 of the type which often is used to support advertising signs on the top of buildings. In this case, both the upstanding portion 52 and the cap 70 are cut with an angle shaped opening and sealed with the sealant 60 and 61 as shown in FIG. 11. The cap 70 allows any normal structural shape to be sealed.

In each of these embodiments, the success of the roof jack depends, also in the unitary member being stable in shape when installed, not degraded by sunlight or temperature extremes, not damaged by atmospheric conditions and to exhibit a service life of at least as long as the roofing which it serves. Preferably, the roof jack should last as long as the service life of the building or residence. To meet these standards, the selection of material used for the roof jack is critical. Most plastic materials fail to meet the requirements stated above plus the ability to be vacuum formed to their final shape. Vacuum forming is preferred to injection molding since the process is to an extent an annealing step which tend to minimize local stresses rather than introduce stress in the finished part as is done by injection molding.

In certain applications, the roof jack must conform to non-planar roofs such as Spanish tile roofs which use generally semi-circular tiles which may be tapered slightly along their length.

Again, the roof may vary in pitch and vents must be sealed and not interfere with the laying or operation of the roof. In certain cases, the planar portion of the roof jack may rest on the planar roof base but may also be required to conform to the roof tiles. Such an embodiment is illustrated in FIGS. 15-19 to which reference is now made. In FIG., 15, a roof jack generally designated 100 includes a normally planar portion 101 which is characterized by a number of longitudinal corrugations 102. The corrugations 102 are integrally formed in the vacuum forming process and preferably are in the order of 0.5 inch (1.22cm) in width and 0.25 (0.6 cm) in height although these dimensions are representative, not critical. The corrugations 102 extend in the direction of the slope of the roof. They form a preferred direction of bending of the planar portion and will easily allow its bending through approximately a 180 degree bend.

The planar portion 101 includes a central upstanding flexible section 103 which is truncated at its sides 104 and 105 to conform more easily to longitudinally shaped roof tiles 121. The upstanding portion 103 includes deformable steps 110, 111, 112 and 113 and circular severable sections, for example, 114*a-f* which accept different sizes vent pipes from 3.5 in (8.9 cm) to 1 inch (2.54cm) outside diameter. The deformable members easily allow deformation of the severable sections 114*a-f* over an arc of at least zero to 45 degrees roof pitches. As formed the severable portions 114*a -f* have an axis A—A which is inclined at an angle of 10 degrees, a common intermediate roof pitch.

Not only does the planar portion 101 need to bend along the lines of the roof tiles, but it should not have its residual plastic memory attempt to lift the overlying tile. This unwanted effect is minimized by the presence of a bendable integrated reinforcement in the form of a metal wire 115 contained within the region of the front edge 120 of the planar portion 101. The wire 105 is easily bendable by hand pressure on the front edge region 120 of the roof jack 100. The installer may bend the wire reinforced edge as he installs it or may prebend it using a roof tile such as tile 121 of FIGS. 18 and 19.

Figure 16:
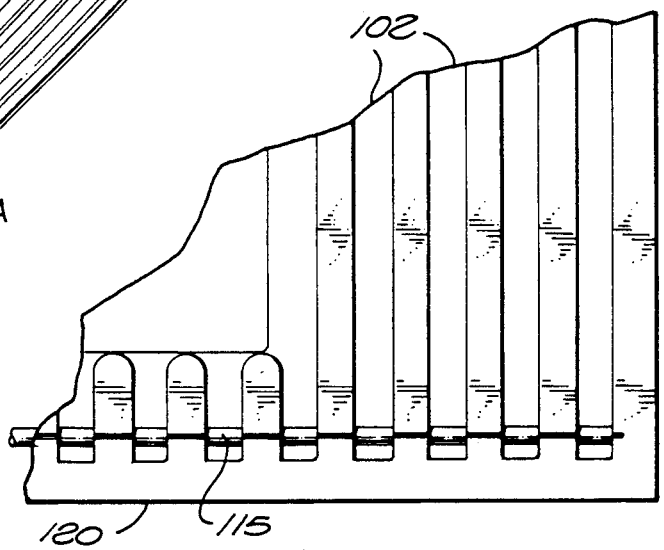
FIG. 16 is a fragmentary plan view of the embodiment of FIG. 15.
Figure 17:
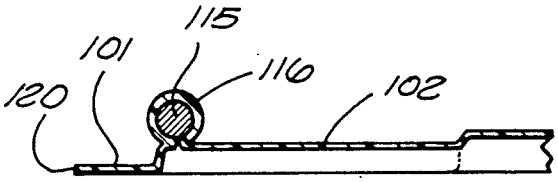
FIG. 17 is a fragmentary vertical sectional view of the bendable stiffener portion of the embodiment of FIG. 15 taken along lines 17—17 of FIG. 15.
Figure 19:
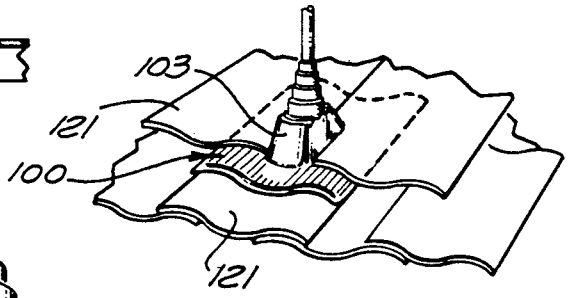
FIG. 19 is a perspective view of a roof jack of this invention installed on a tile roof.
Figure 18:
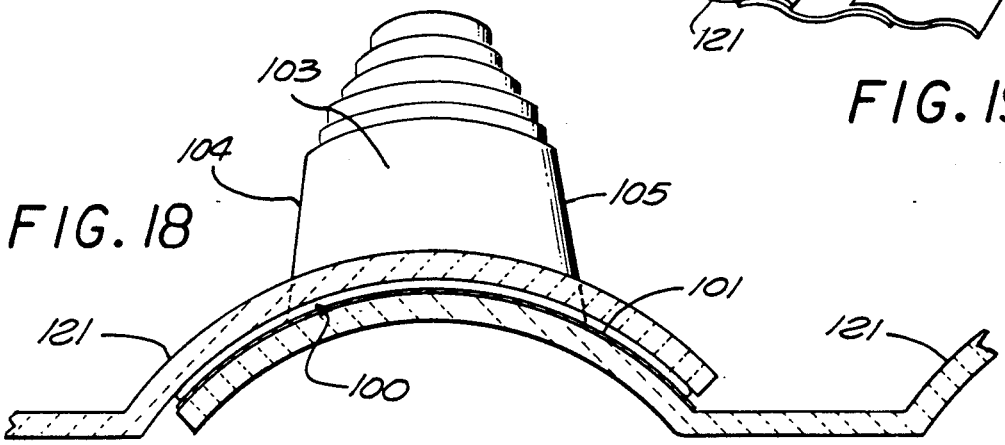
FIG. 18 is an end view with roof tiles in section of the embodiment of FIGS. 15–17, in place in a tile roof.

The wire 115 or flat strap is virtually imbedded in the rib 116 in the vacuum forming process in which the transverse groove is nearly closed as may be seen in FIGS. 16 and 17. The vacuum enclosing of the wire provides a form connection with the plastic roof jack and assured bending to match the roof tile configuration.

The foregoing constitute illustrative embodiments of this invention are not to be considered as limiting. Rather, this invention is defined by the following claims including the protection afforded by the doctrine of equivalents.

What is claimed is:

1. A rooj jack or vent seal for use on a generally planar pitched roof having a vent or structure extending upward through the roof and requiring a weather seal comprising:

a flexible vacuum formed unitary plastic member of polymeric-synthetic rubber material including a generally planar portion;

said generally planar portion surrounding an upstanding portion;

said upstanding portion including a plurality of coaxial substantially parallel stepped reduced diameter tubular portions, each including an upstanding portion of substantial length having an internal dimension generally cooresponding to the outside dimensions of a structure to be used with said roof jack; and said flexible plastic member including a transition portion between said base portion and at least one of said tubular portions;

said transition portion including at least one corrugation which will flex to allow the generally planar portion to conform to the plane of the roof to which the roof jack is secured permitting the tubular portion to extend generally parallel to the length of a structure extending therethrough;

said flexible plastic member being severable at the tubular portion corresponding to the outside dimension of the vent.

2. A roof jack or vent seal in accordance with claim 1 wherein said upstanding portion of said plastic member is of generally frusto-conical shape.

3. A roof jack or vent seal in accordance with claim 1 wherein said flexible plastic member is formed in its finished shape by vacuum forming from a planar sheet of plastic material.

4. A roof jack or vent seal in accordance with claim 2 wherein said upstanding portion in included in the range of 0 to 20 degrees with respect to said planar portion.

5. A roof jack or vent seal in accordance with claim 1 wherein said base section is truncated to provide flat sides on opposite sides thereof.

6. A roof jack or vent seal in accordance with claim 1 wherein said transition portion includes at least two corrugations capable of at least 10 degrees of flexing to accomodate variations in roof pitch without significant distortion of said stepped reduced diameter tubular portions.

7. A roof jack or vent seal in accordance with claim 1 wherein said stepped portions are at least two in number.

8. A roof jack or seal for use on a contoured pitched roof such as a tile roof having a vent or structure extending upward through the roof and requiring a weather seal comprising:

a flexible vacuum formed unitary plastic member including a transversely extending sheet-like portion surrounding an upstanding portion;

said transversely extending portion including a plurality of longitudinally extending corrugations providing a preferred direction of bending above or below the upstanding portion;

a deformable length of metal secured to said flexible plastic member for retaining said transversely extending portion in a preselected position by bending of said length of metal;

said upstanding portion including an upstanding length having an internal dimension corresponding to the outside dimensions of a structure to be used with said roof jack or vent seal;

said flexible plastic member including a transition portion between said upstanding portion and said upstanding length;

said transition portion including at least one corrugation which will flex to allow the generally planar portion to conform to the plane of the roof to which the roof jack or vent seal is secured while the upstanding length may extend generally parallel to the length of a structure extending through said roof.

9. A roof jack or seal in accordance with claim 8 wherein said transversely extending portion includes a plurality of longitudinally extending corrugations providing preferred direction of bending in the transverse direction.

10. A roof jack or seal in accordance with claim 8 wherein said flexible plastic member is unitary.

11. A roof jack or vent seal in accordance with claim 9 including deformable means secured to said flexible member for retaining said transverse extending portion in a preselected configuration by bending of said deformable means.

12. A roof jack or vent seal in accordance with claim 8 wherein said length of metal wire is at least partially enclosed by said flexible member.

13. A roof jack or vent seal in accordance with claim 8 wherein said length of metal wire extends in a transverse direction generally at the lower or front edge of said roof jack or vent seal when installed on a roof.

14. A roof jack or seal in accordance with claim 8 wherein said deformable length of metal comprises a length of wire.

15. A roof jack or seal for use on a contoured pitched roof such as a tile roof having a vent or structure extending upward through the roof and requiring a weather seal comprising:

a flexible vacuum formed unitary plastic member including a transversely extending sheet-like portion surrounding an upstanding portion;

said transversely extending portion including a plurality of longitudinally extending corrugations providing a preferred direction of bending above or below the upstanding portion;

a length of deformable metal wire secured to said flexible member for retaining said transverse extending portion in a preselected configuration by bending said wire;

said upstanding portion including an upstanding length having an internal dimension corresponding to the outside dimensions of a structure to be used with said roof jack or vent seal;

said flexible plastic member including a transition portion between said upstanding portion and said upstanding length;

said transition portion including at least one corrugation which will flex to allow the generally planar portion to conform to the plane of the roof to which the roof jack or vent seal is secured while the upstanding length may extend generally parallel to the length of a structure extending through said roof.

* * * * *